US007040495B2

(12) United States Patent
Ascik et al.

(10) Patent No.: US 7,040,495 B2
(45) Date of Patent: May 9, 2006

(54) POINT OF SALE DISPLAY CONSTRUCTIONS, SYSTEMS AND METHODS FOR CONSUMER PRODUCTS

(75) Inventors: Mark A. Ascik, Ormond Beach, FL (US); James D. Means, Ormond Beach, FL (US)

(73) Assignee: StyleMark, Inc., Ormond Beach, FL (US)

( * ) Notice: Subject to any disclaimer, the term of this patent is extended or adjusted under 35 U.S.C. 154(b) by 38 days.

(21) Appl. No.: 10/440,509

(22) Filed: May 16, 2003

(65) Prior Publication Data

US 2004/0007551 A1 Jan. 15, 2004

Related U.S. Application Data

(63) Continuation-in-part of application No. 10/005,389, filed on Dec. 3, 2001, now Pat. No. 6,564,953.

(60) Provisional application No. 60/258,166, filed on Dec. 22, 2000.

(51) Int. Cl.
*A47B 43/00* (2006.01)

(52) U.S. Cl. ..... 211/189

(58) Field of Classification Search ..... 211/163, 211/189, 85.2, 85.1, 13.1
See application file for complete search history.

(56) References Cited

U.S. PATENT DOCUMENTS

| | | | | | |
|---|---|---|---|---|---|
| 1,425,846 | A | * | 8/1922 | Franks | 211/163 |
| 4,155,457 | A | * | 5/1979 | Wilbert | 211/4 |
| 4,322,007 | A | * | 3/1982 | Feibelman | 211/163 |
| 5,078,283 | A | * | 1/1992 | Wilson | 211/187 |
| 5,255,803 | A | * | 10/1993 | Pavone et al. | 211/189 |
| 5,794,782 | A | * | 8/1998 | Ascik | 206/600 |
| 5,853,090 | A | * | 12/1998 | Brozak, Jr. | 211/13.1 |
| 5,890,607 | A | * | 4/1999 | Maglione | 211/189 |
| 6,041,948 | A | * | 3/2000 | Filipak et al. | 211/85.1 |
| 6,073,782 | A | * | 6/2000 | Ascik | 211/85.1 |
| D445,273 | S | * | 7/2001 | Brown et al. | D6/396 |
| 6,443,317 | B1 | * | 9/2002 | Brozak, Jr. | 211/85.1 |
| 6,564,953 | B1 | * | 5/2003 | Ascik | 211/189 |

* cited by examiner

*Primary Examiner*—Sarah Purol
(74) *Attorney, Agent, or Firm*—Allen, Dyer, Doppelt, Milbrath & Gilchrist, P.A.

(57) ABSTRACT

A display stand for presenting consumer merchandise and which permits flexibility in the stocking and the aesthetic appearance of the merchandise includes at least one pair of elongated corner members which extend along a substantial portion of the vertical dimension of the stand, with each pair of corner members positioned and dimensioned to slidably receive vertically-extending and parallel first and second panels which may be used to control the appearance of the display, present different types of merchandise as seasonally required or change the graphics or appearance of the display.

19 Claims, 17 Drawing Sheets

POINT OF SALE DISPLAY CONSTRUCTIONS, SYSTEMS AND METHODS FOR CONSUMER PRODUCTS

CROSS-REFERENCE TO RELATED APPLICATIONS

This application is a continuation-in-part of application Ser. No. 10/005,389 filed Dec. 3, 2001, which was based upon provisional application Ser. No. 60/258,166 filed Dec. 22, 2000, both of which are commonly owned with this application.

BACKGROUND OF THE INVENTION

1. Field of the Invention

The present invention relates generally to constructions, systems and methods for displaying consumer products at a point of sale. In particular, the present invention relates to display systems and methods designed to be easily converted for seasonal product variations, to modify the appearance of the display, to facilitate restocking and/or to change design elements (i.e., mirrors or graphics) associated with different product lines.

2. Description of the Prior Art

A variety of techniques have been used in the prior art to display consumer products at the point of sale. Of course, many staple products are simply stacked on fixed shelving. However, in the case of higher-priced or seasonal products such as sunglasses, non-prescription eye glasses and costume jewelry, the products are frequently attached to a hang tag and suspended from pegs or slots on a vertical panel fixed to a floor stand. Typically, several vertical panels are attached together with vertical posts in a pleasing display on a single floor stand, and may be rotated about a vertical axis so that a stationary customer may view the products on all of the panels. Examples of prior art displays include those shown in U.S. Pat. Nos. 5,794,782 and 5,257,703, both to Ascik.

Prior art rotating vertical stands are often used to display seasonal merchandise such as sunglasses, jewelry and tanning lotions. As the goods are sold down during the season, the display becomes partially empty and thus less appealing to the consumer.

It is a custom in some industries for the manufacturer of the goods to supply the display stand to the retailer. In such cases, when a display stand with seasonal merchandise is occupying needed retail floor space during the off season, the retailer will often throw the display stand away. In that event, the manufacturer will be required to bear the expense of supplying another display stand to the retailer upon the arrival of the next selling season.

SUMMARY OF THE INVENTION

The present invention is directed to display stand constructions, systems and methods which are designed to overcome the limitations discussed above, and to provide display stands which are converted in a facile manner at the point of sale to display or store different merchandise or a more limited amount of merchandise in a pleasing manner, to permit restocking for change of merchandise, or to permit the changing of graphics and other advertising in a facile manner. In several arrangements, display stand constructions according to this invention employ vertical spaced corner posts adapted to receive different display panels which slide into engagement with, or are fitted between adjacent pairs of the posts.

Further in accordance with this invention, the corner posts are also adapted to receive between adjacent pairs one or more supplemental panels which may be inserted in front of or behind an existing display panel for any one of a plurality of purposes, including providing a more pleasing appearance to the consumer as the merchandise on the existing display panel is sold down, altering the appearance of the display or for restocking purposes. Alternatively, the supplemental panel may be used to display the same merchandise, or different merchandise than is displayed on the principal display panel.

In a first embodiment, the above objectives are achieved using a construction employing at least one pair of vertical corner posts, in which adjacent pairs of posts are spaced apart by a distance which defines a display opening, the dimensions of the display opening being generally equal to that of a display panel to be snapped into or slidably fitted between the adjacent posts. In a specific arrangement, each post defines a corner of the display and includes a side facing an adjacent post with at least two recessed slots in each facing side. A first one of the slots in each of the adjacent pairs of posts is dimensioned to receive a side of a first display panel which is snapped or slidably fitted into place in the first slots, usually with merchandise already mounted onto the panel. The second slot extends generally parallel with the first slot along the facing side of each post and is dimensioned to receive the supplemental panel.

The display stand constructions, systems and methods of the present invention are also adapted to receive display panels of different configurations. For example, the display opening between the facing sides of adjacent pairs of the posts may be dimensioned to receive a display panel formed as a corrugated tray having a display face and sides extending a short distance laterally from the display face, on the order of 2"–3", to provide structural integrity. In order to accommodate display panels of this type, the posts may be provided with a rear stop positioned rearwardly of and extending beyond the first slot of the facing side.

Additionally, the display stand constructions and methods of the present invention are also adapted and dimensioned to receive removable shelving or storage containers in the display opening between adjacent posts. In such an arrangement, the shelving or storage containers are dimensioned to fit within the display opening and, if necessary, between the extremities of opposing rear stops and rearwardly into the internal space of the display stand.

In a second embodiment of the point of sale display constructions, systems and methods of the present invention, the vertical display stand comprises at least two spaced vertical supports fitted upon an upper surface of a horizontal member which, in turn, is supported in a rotatable fashion upon a base. The vertical supports are held rigidly in space relation by upper and lower braces. The vertical supports preferably comprise flat sheet materials such as plywood, pressboard or any number of molded plastic sheet materials.

In this second embodiment, the vertical supports are essentially identical and face each other in a mirror image relationship, with sets of two or more vertical slots along the inside face of each vertical support, and with display panels vertically supported between opposing slots. In this arrangement, the construction is provided with corner posts which slidably engage the outer ends of the vertical supports with a retaining tab fitting into corresponding vertical slots along the outside surfaces of each of the vertical supports. Preferably, the corner posts are fabricated from an extruded plastic material, and include at least two slots along an inside surface facing an opposing post having corresponding slots, to support two or more additional display panels.

A detailed description of the drawings and preferred embodiments of the display stand constructions and methods of the present invention are set out next. It will of course be understood by those skilled in the art from the drawings and detailed descriptions that other constructions and methods may be employed which fall within the spirit and scope of this invention.

DETAILED DESCRIPTION OF THE PREFERRED EMBODIMENTS

Figure 1:
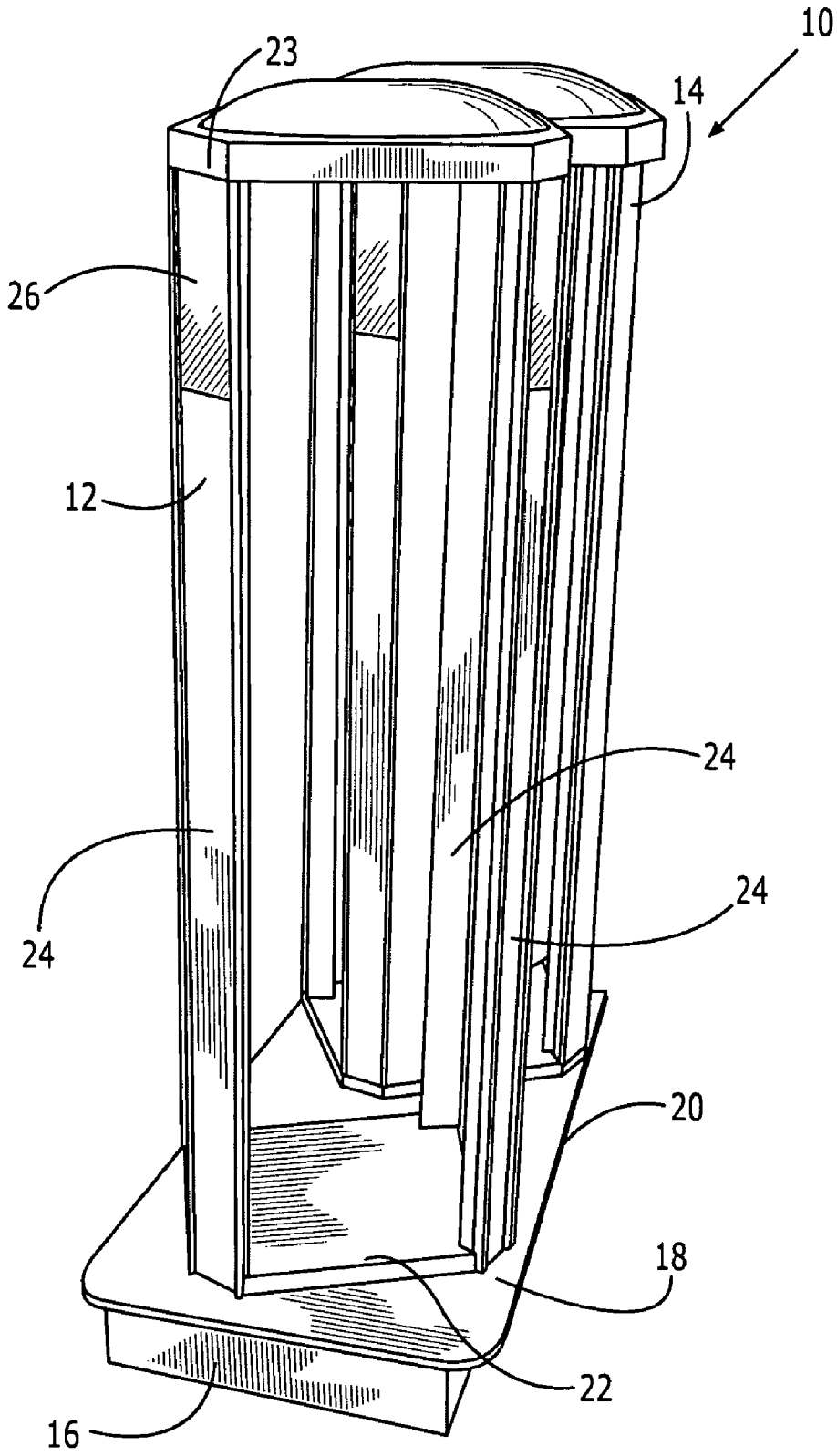
FIG. 1 is a perspective view illustrating a portion of a display stand system and construction in accordance with a first embodiment of the present invention.
Figure 2:
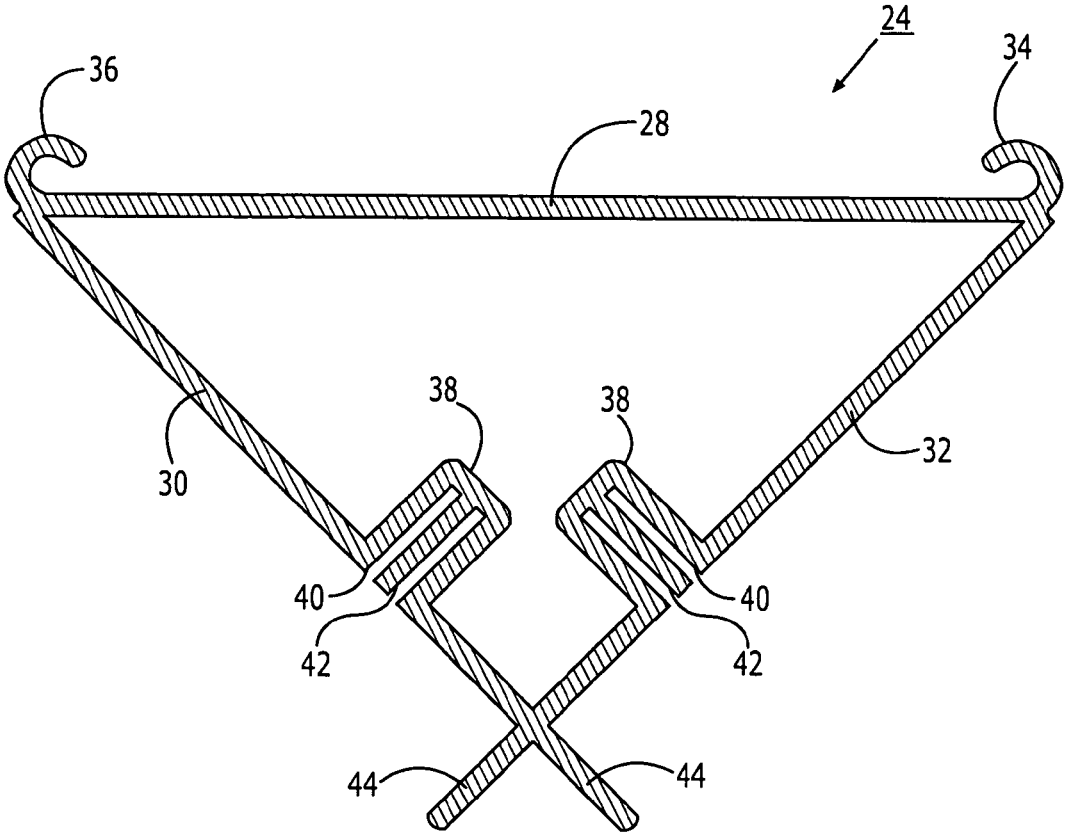
FIG. 2 is a cross-sectional view of a corner post useful in the display stand system and construction shown in FIG. 1.
Figure 3:
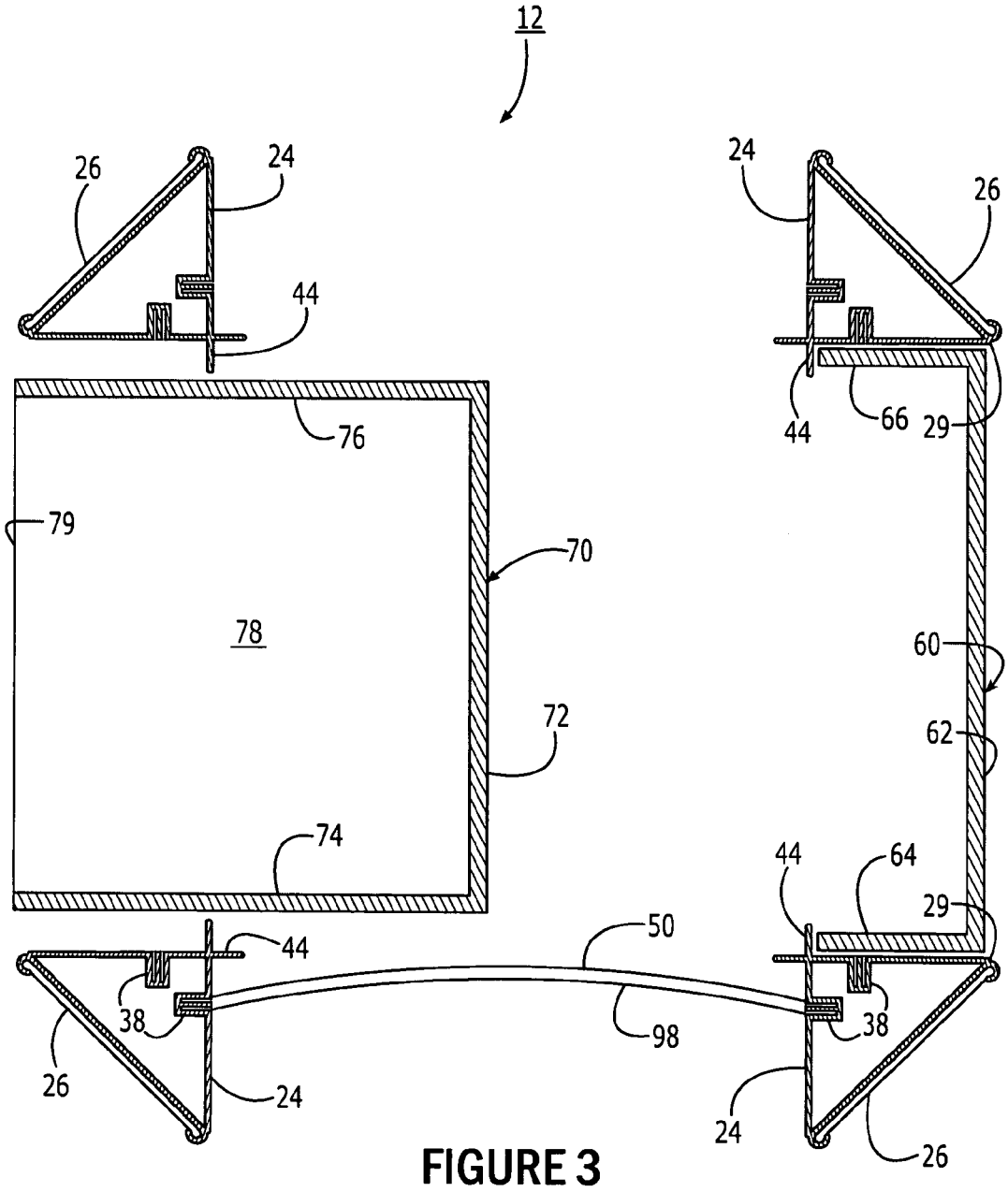
FIG. 3 is a cross-sectional illustration of a portion of the system and construction of the display stand like that shown in FIG. 1, in which different display panels are illustrated as used with a plurality of corner posts.

Turning first to FIGS. 1–3, there is illustrated at FIG. 1 a display construction 10 having two generally vertical display stands 12, 14 mounted on a base plate 18, which in turn is mounted upon a stand 16. Although not shown in FIG. 1, the stand 16 may include rollers or casters to permit the entire assembly 10 to be wheeled about.

The base plate 18 includes an upper surface 20 to which is attached the vertical display stands 12, 14 in such a manner as to be rotatable around a vertical axis of rotation passing generally through each respective stand 12, 14. Each display stand 12, 14 includes a base 22 and a top 23, with four corners formed of spaced, relatively rigid corner posts 24 extending vertically between the base 22 and the top 23. The construction details of each post 24 and the manner in which each post 24 permits various display panels to be snapped into or slidably fitted between adjacent pairs of posts will be described in greater detail below with reference to FIGS. 2 and 3.

Each display stand may include a mirror 26 mounted upon one or more corner posts 24. The mirror 26 is useful for consumers to try on merchandise suspended upon display panels fitted between adjacent pairs of edge molding 24, as described below.

Turning now to FIG. 2, corner post 24 comprises an elongated member of a molded or extruded plastic material which is formed in a generally triangular cross section so as to have an outer side 28, and inner sides 30, 32. The outer side 28 is provided with opposing retainers 34, 36 useful in holding the mirror 26 (FIG. 3) or promotional cards. Each of the inner sides 30, 32 is provided with a slot member 38 extending generally laterally from the respective side and defining a first, inner slot 42 and a second, outer slot 40. Additionally, each inner side 30, 32 includes a stop 44 extending generally laterally away from the inside extremity of each inner side.

Turning now to FIG. 3, a display stand construction 12 in accordance with the first embodiment of the present invention employs four corner posts 24 like that shown in FIG. 2. Adjacent corner posts 24 are spaced apart a distance which defines a display opening equivalent in dimension to a display panel 50, 60 or 70. Display panel 50 is shown in greater detail in FIG. 7. Display panel 50 comprises a thin sheet of flexible material which is snapped into or slidably fitted at opposite ends into first, inner slots 42 of a pair of the opposing corner posts 24.

Figure 7:
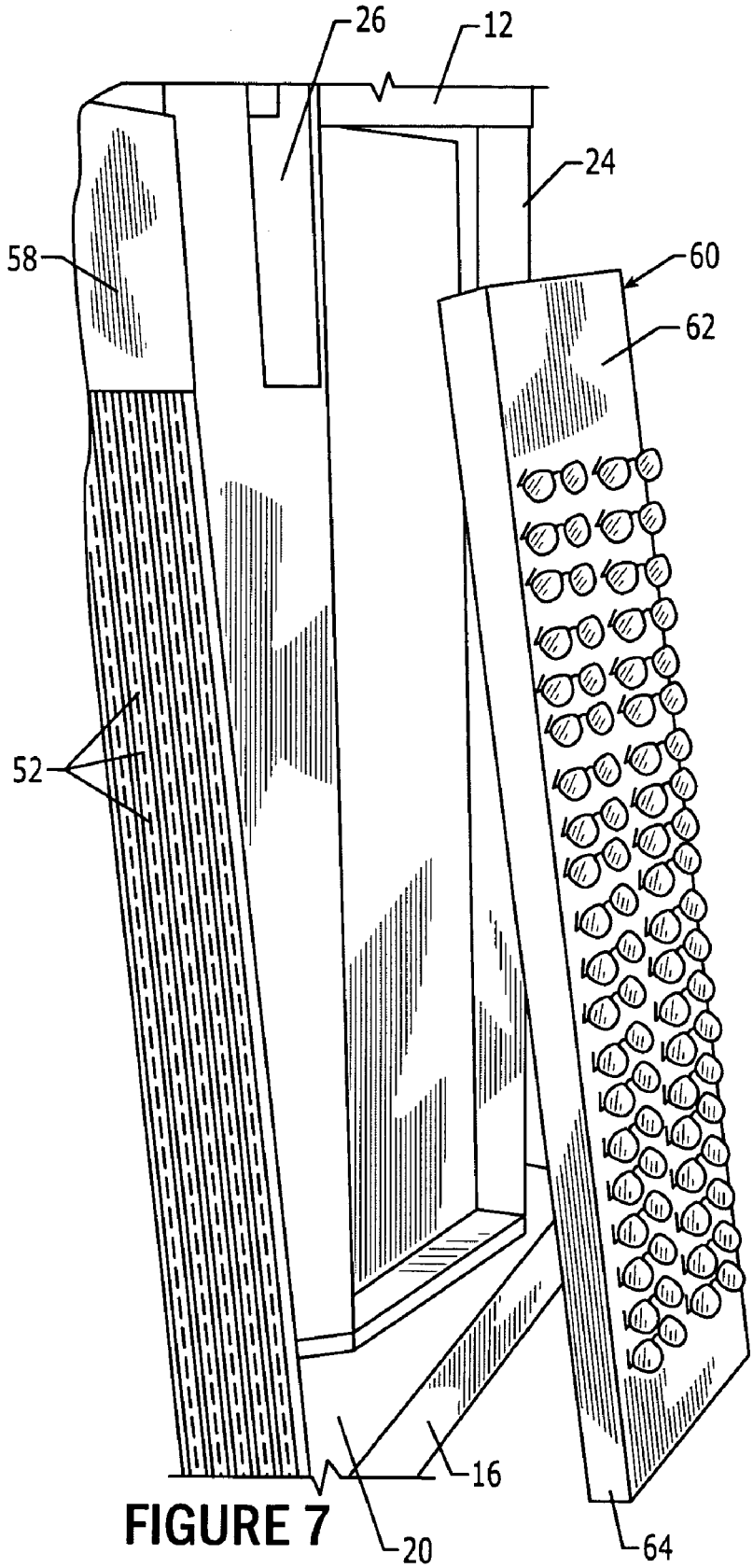
FIG. 7 is a partially cut-away perspective view of the display system showing alternative display panels useful with a display system and construction.
Figure 8:
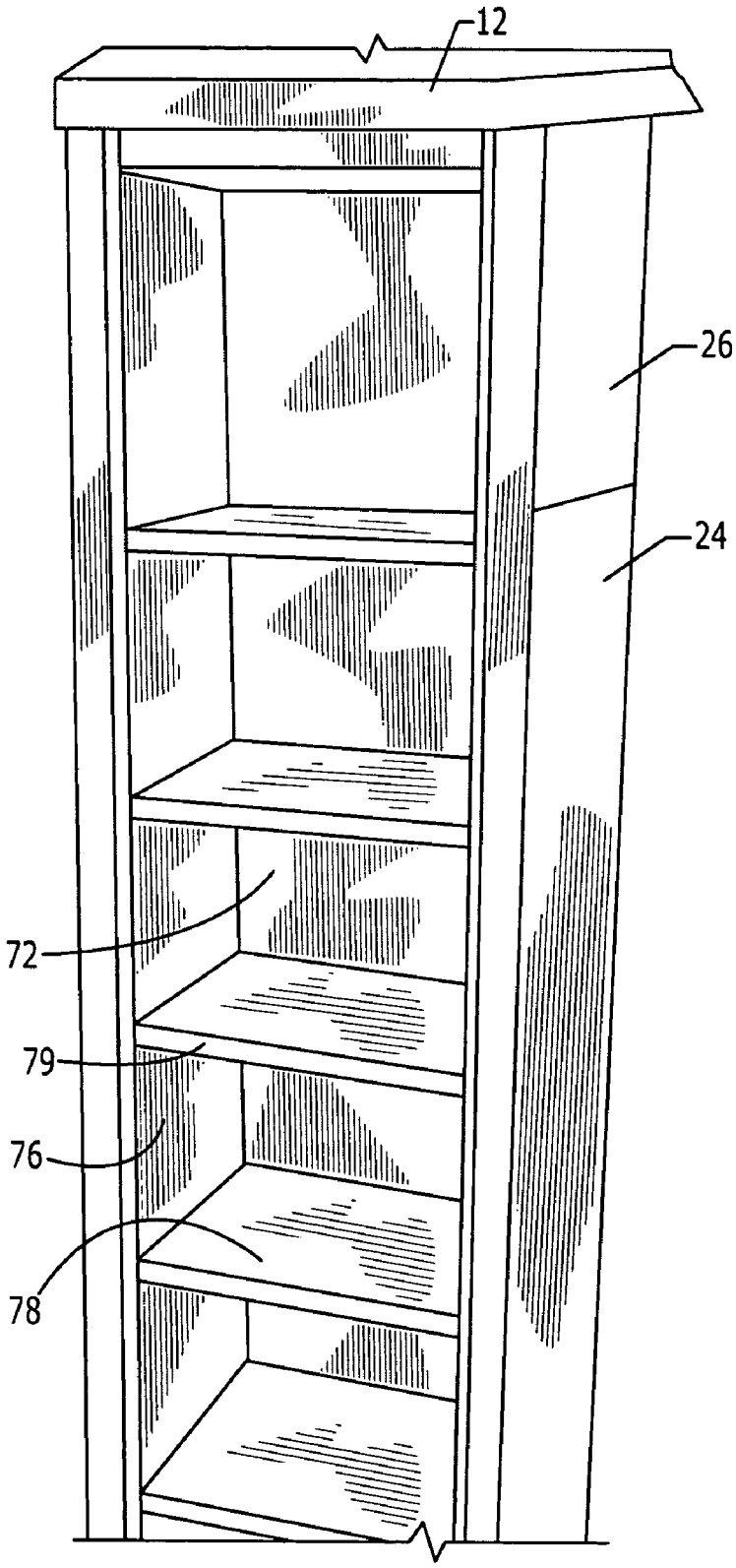
FIG. 8 is a partially cut-away perspective view of a display stand like that shown in FIGS. 1–3, and illustrating in side view one of the alternative display panels shown in FIG. 3.

Again noting FIG. 3, a second display panel 60 comprises a tray formed of corrugated material having a front panel 62 and side panels 64, 66 which extend in the opening between adjacent panels and are dimensioned to rest against the stops 44 of adjacent posts 24 with the front panel 62 extending to the front edges 29 of the adjacent corner posts (see FIG. 3). Display panel 60 is also shown in FIG. 7. A third display panel 70 comprises a corrugated shelf member having a back panel 72, side panels 74, 76 and shelf panels 78 and is dimensioned to fit between the adjacent stops 44. Display panel 70 is shown in greater detail in FIG. 8.

Figure 9:
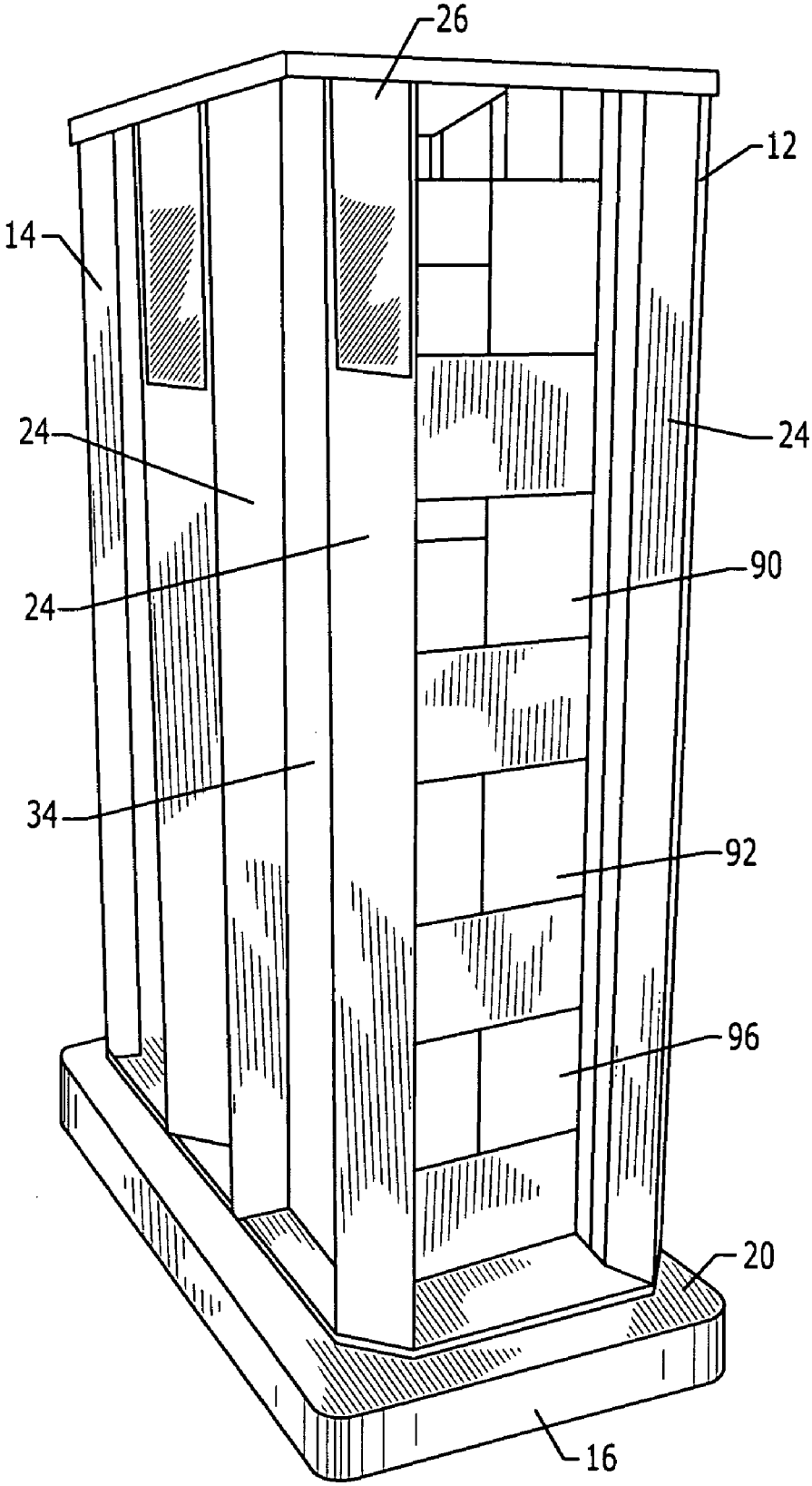
FIG. 9 is perspective view of the display stand system illustrating another alternate form of a display panel for insertion between adjacent corner posts.

In addition to display panels 50, 60 and 70 as discussed above, display panel 90 shown in FIG. 9 may also be employed for insertion into the display opening defined by two of the four corner posts 24 in FIGS. 1 and 3. As shown in FIG. 9, display panel 90 includes vertical corrugated sides 92, 94 and slidable corrugated drawers 96. When necessary, display panel 90, like panel 70, may be dimensioned to extend into the display stand 12 between adjacent stops 44. A supplemental panel 98 (FIG. 6) may also be used with the display stand 12, for the purposes discussed above.

Figure 4:
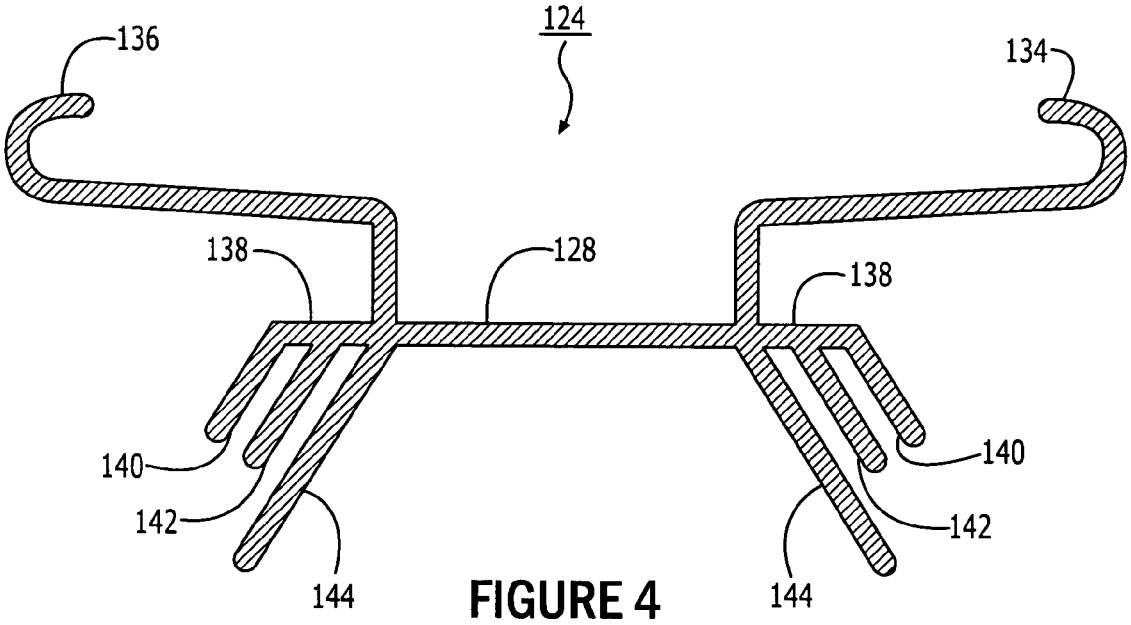
FIG. 4 is a cross section of another embodiment of a corner post in accordance with the present invention.

A second embodiment of a corner post construction in accordance with the present invention is illustrated in FIG. 4 and referred to generally with reference numeral 124. Corner post construction 124 includes a front side 128 and slot members 138, each of which define a first, inner slot 142 and a second, outer slot 140 both extending laterally from the inside of side 128. Additionally, each side of the corner post 124 is provided with a stop 144. Opposing retainers 134, 136 are adapted to hold mirror 26 or a promotional card.

Figure 5:
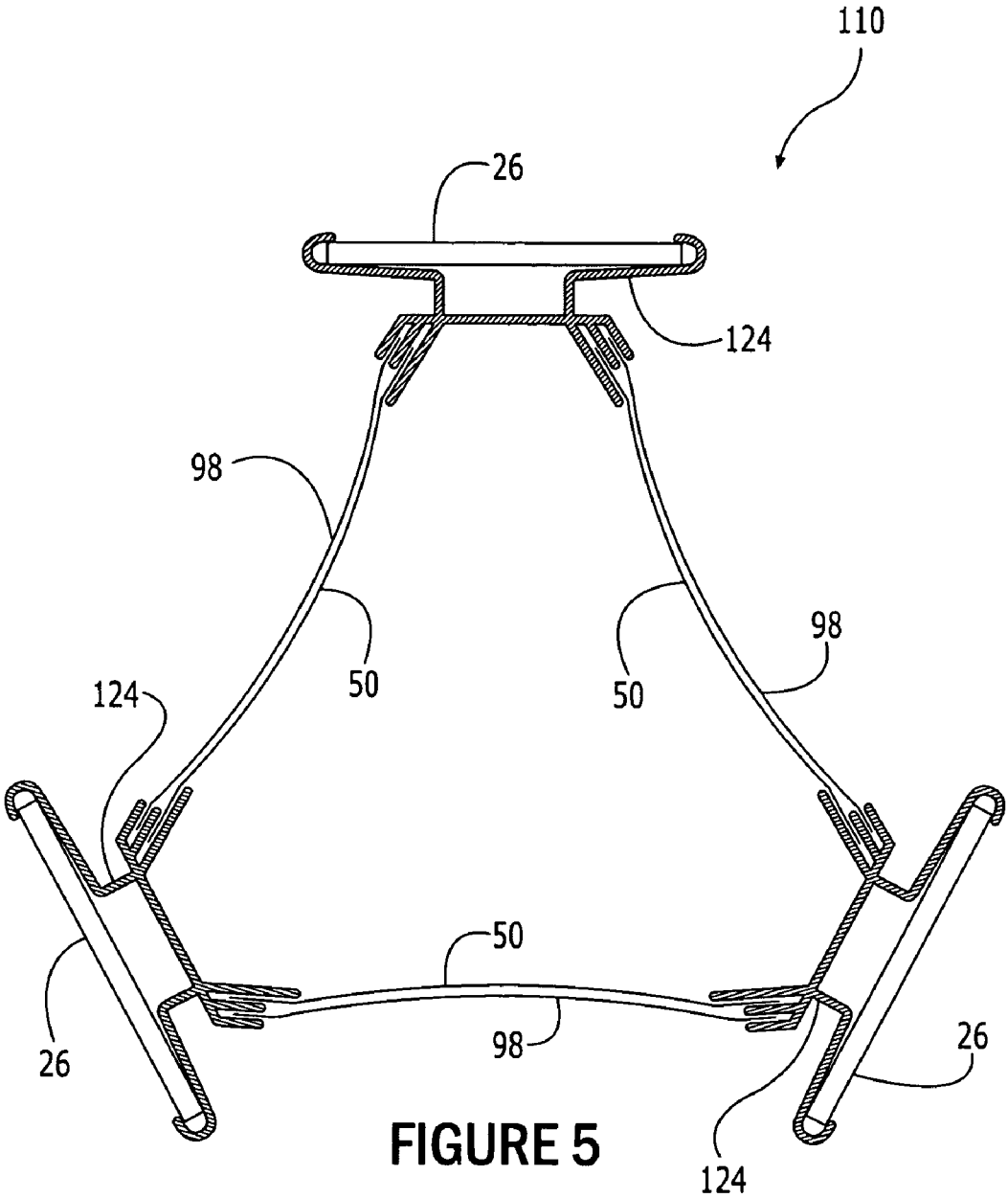
FIG. 5 is a cross sectional illustration of a display stand construction utilizing at three corners the corner post of FIG. 4, and illustrating the manner in which a supplemental panel is inserted in front of a display panel.

The particular manner in which the corner post construction of FIG. 4 is utilized in a display stand construction 110 is shown in the cross section of FIG. 5. Display panels 50 are shown inserted in the first, inner slot 142 of adjacent pairs of corner posts 124, with supplemental panels 98 inserted in front of each display panel 50 in the second, outer slots 140 of adjacent corner posts 124.

Figure 6:
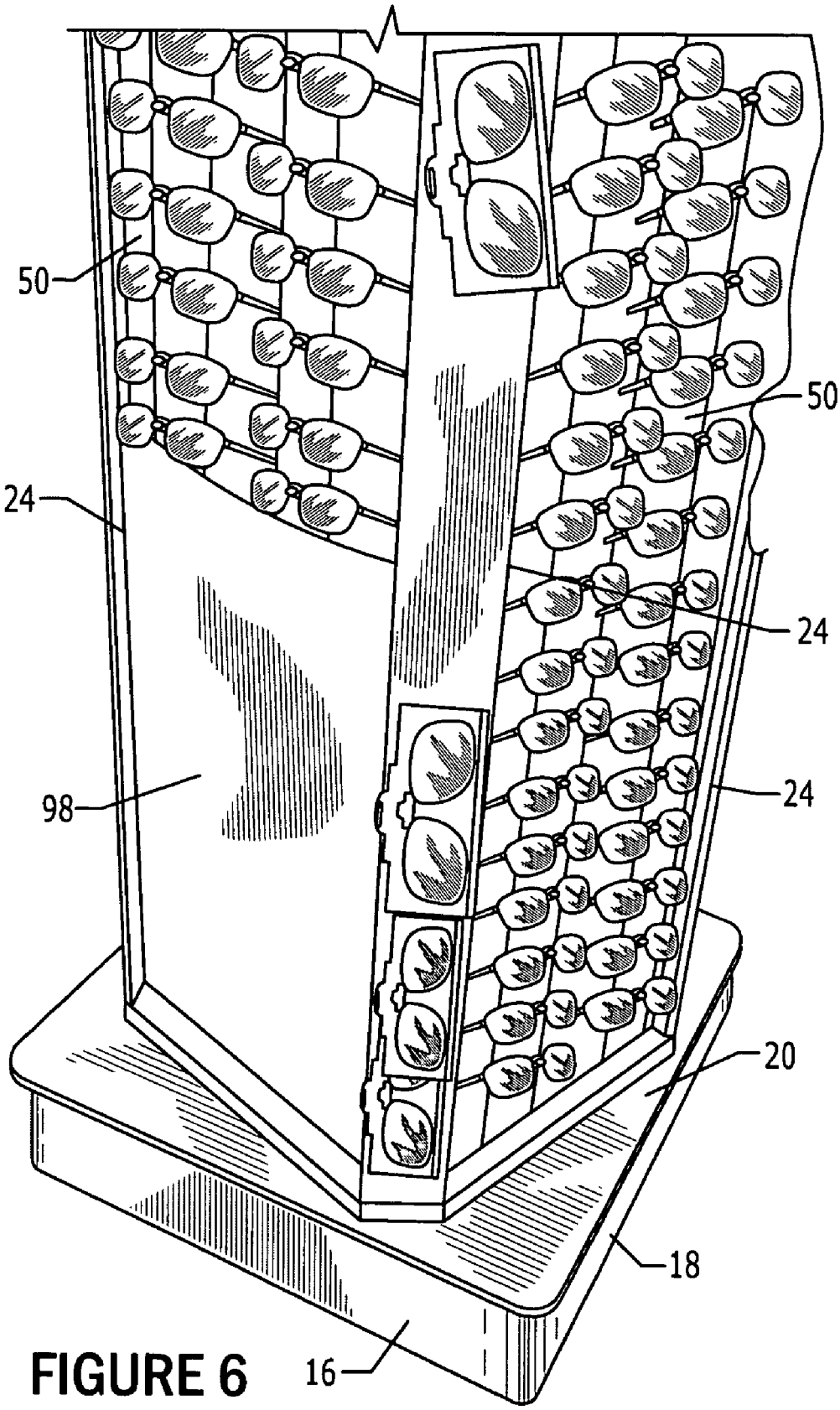
FIG. 6 is a perspective view of a cut-away portion of the display stand, illustrating the use of the supplemental panel.

The supplemental panel 98 is shown in greater detail in FIG. 6, and may, by way of example, comprise a graphic or other promotional insert which permits merchandise to be moved into the upper portion of the display panel 50, thereby avoiding the unsightly appearance of a display panel which contains only a small portion of merchandise. Alternatively, another type of merchandise (such as costume jewelry) may be carried by the supplemental panel 98. Further, the outer display panel 98 may be fabricated of a transparent material so that a graphic design or mirrored surface on the inner display panel 50 can be seen through the panel 98.

The second embodiment of the present invention will now be described with reference to FIGS. 10–15, where the display stand construction and system is indicated generally by reference numeral 210.

As shown in FIGS. 10–13, the display 210 comprises a vertical display stand 212 supported upon an upper surface 214 of a base 216 with an intermediate, rotatable "Lazy Susan" type unit (FIG. 11) to permit the display stand 212 to be rotated as shown by arrows 220, 222.

Figure 11:
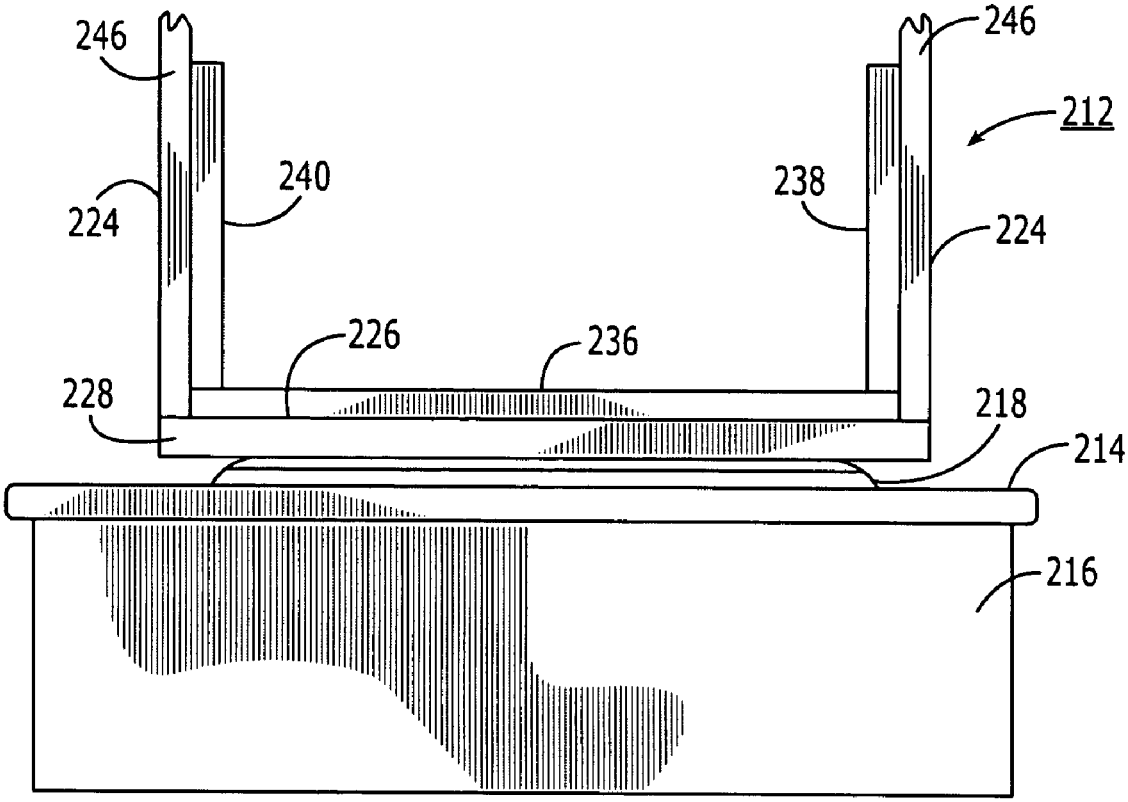
FIG. 11 is a side view of a portion of the display stand construction shown in FIG. 10.

The display stand 212 comprises at least two spaced vertical supports 224 both of which are fitted to the upper surface 226 of a horizontal member 228. As shown in FIG. 11, the horizontal member 228 is, in turn, mounted upon the "Lazy Susan" rotation unit 218. The vertical supports 224 are held in spaced relation by an upper brace 230 having extending arms 232, 234 attached respectively to the inside surfaces 242 of the spaced vertical supports 224, and a lower brace 236 having extending arms 238, 240 which are also fitted to the respective inside surfaces 242 of the vertical supports 224.

Figure 10:
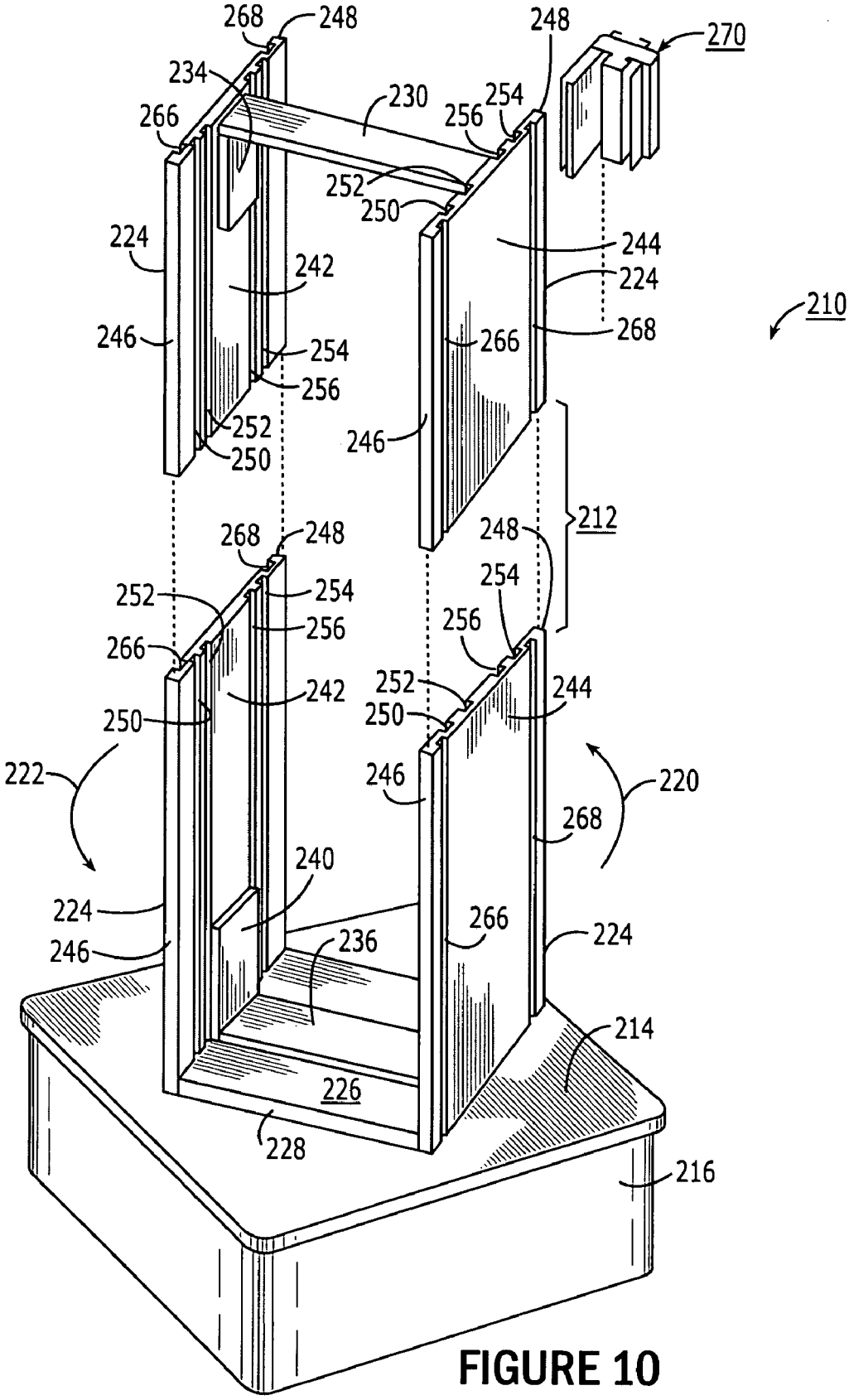
FIG. 10 is a perspective view of the internal construction features of a second embodiment of a display stand system in accordance with the present invention, with a portion of the construction broken away.

The features of each of the vertical supports 224 will now be described with reference to FIGS. 10, 12 and 13. The vertical supports 224 may be fabricated from any suitable flat sheet material, such as plywood, pressboard or a molded plastic material. The vertical supports 224 are spaced apart from each other in a mirror-image relationship, with inside surfaces 242 facing each other and corresponding opposing outside surfaces 244, with opposing ends 246, 248. Each vertical support 224 includes a plurality of slots, for example a pair of slots 250, 252 along the inside surface 242 toward the end 246, and another plurality of slots, for example a second pair of slots 254, 256 toward end 248. It will be appreciated by those skilled in the are that the specific location of each plurality of slots, including the first pair 250, 252 and the second pair 254, 256, is not crucial; however, in the embodiment of FIGS. 10–15, the pairs of slots are spaced somewhat inwardly from the respective edges 246, 248 to achieve certain benefits which are described in detail below.

Each vertical support 224 further comprises a first vertical slot 266 adjacent to and spaced from the end 246 along the outside surface 244, and a second vertical slot 268 adjacent the end 248 along the outside surface 244.

Figure 12:
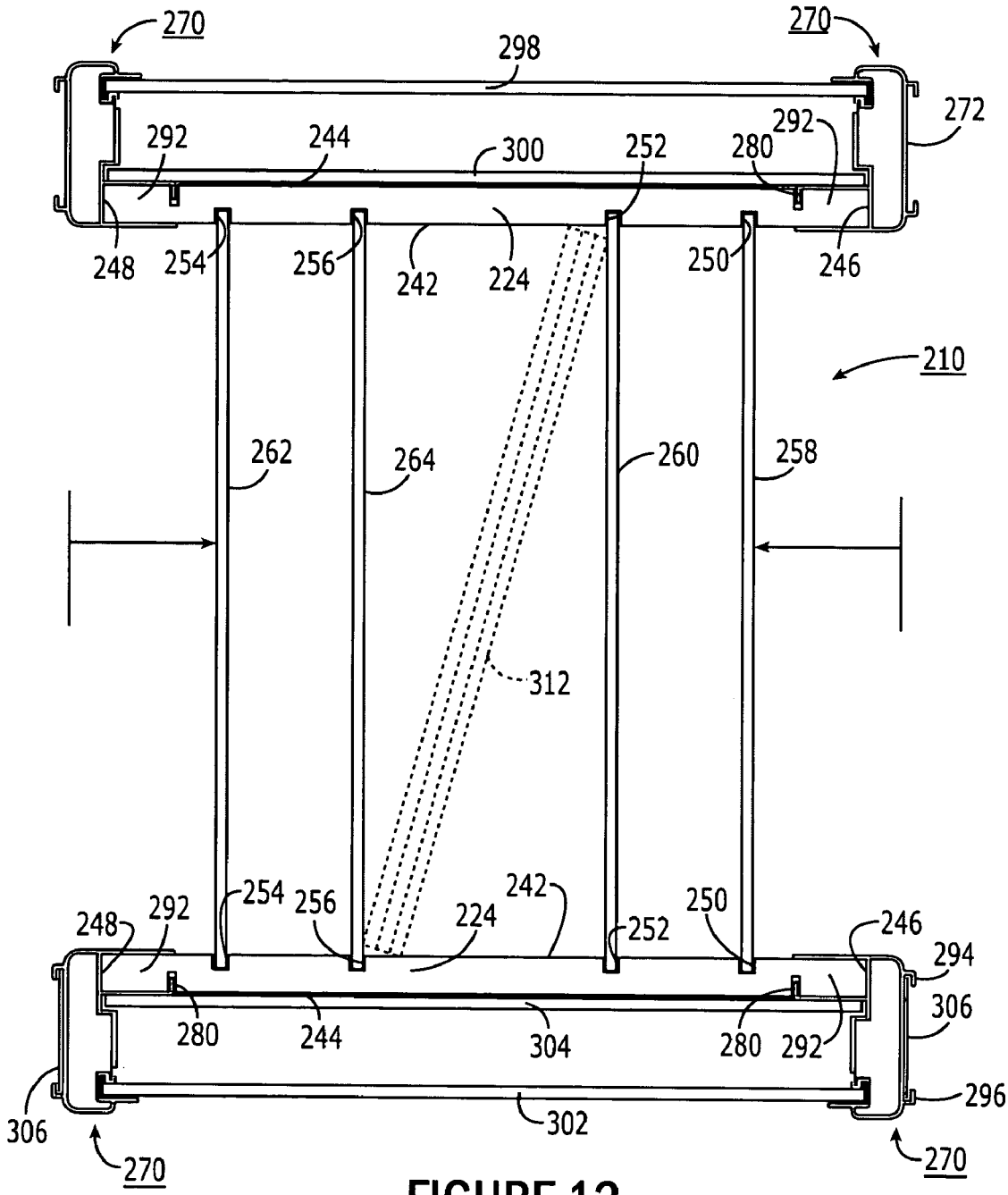
FIG. 12 is a top view of the display stand construction shown in FIG. 10.
Figure 13:
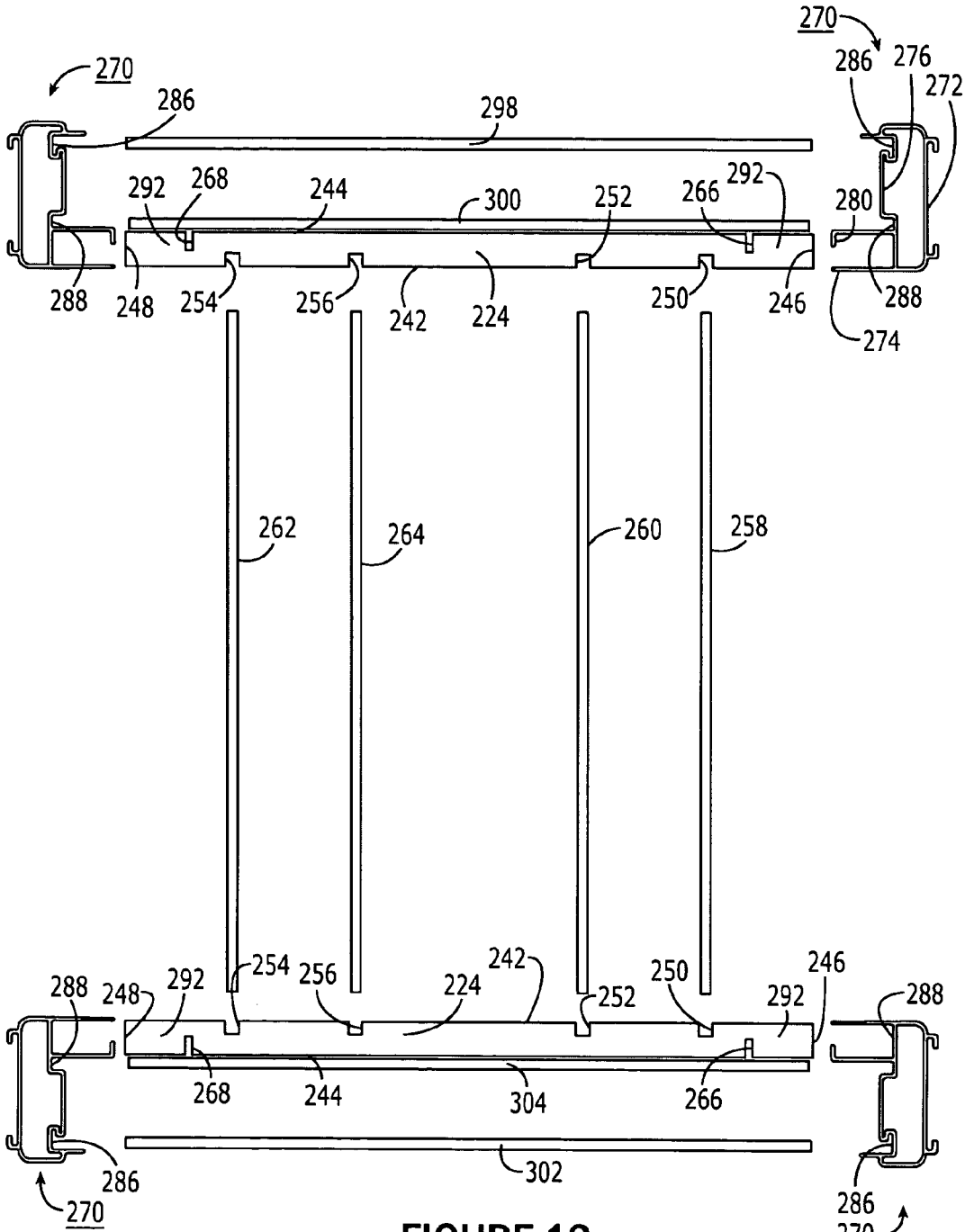
FIG. 13 is an exploded end view of the display stand construction shown in FIGS. 10 and 12.

Reference is now made to FIGS. 12 and 13. A first vertical display panel 258 is slidably retained in a vertical position in vertical slots 250 between the inside surfaces 242 of the vertical supports 224; likewise, a second vertical display panel 260 is slidably retained in slots 252 between the inside surfaces 242 of the vertical supports 224. In a similar manner, a second pair of display panels 262, 264 are respectively slidably retained in vertical slots 254 and 256. The vertical display panels 258, 260, 262 and 264 may, for example, be thin flexible sheet material like the panels described as elements 50 and 98 above with reference to FIGS. 3 and 5.

The manner in which slidable vertical corner posts are utilized to provide additional display panels for the display stand 210 will now be described with reference to FIGS. 10, 12, 13 and 14.

In accordance with another aspect of this invention, a corner post 270 is provided which is slidably engaged along the respective ends 246, 248 of each vertical support 224, in order to permit additional display panels to be mounted onto the display stand 210. In the arrangement shown in FIGS. 10–15, the slidable corner, referred to generally by reference numeral 270, takes the form of a specific plastic extrusion the shape of which is depicted in FIGS. 12, 13 and more particularly in FIG. 14. However, it will be appreciated by those skilled in the art that numerous other configurations may be employed without departing from the spirit and scope of this invention.

Figure 14:
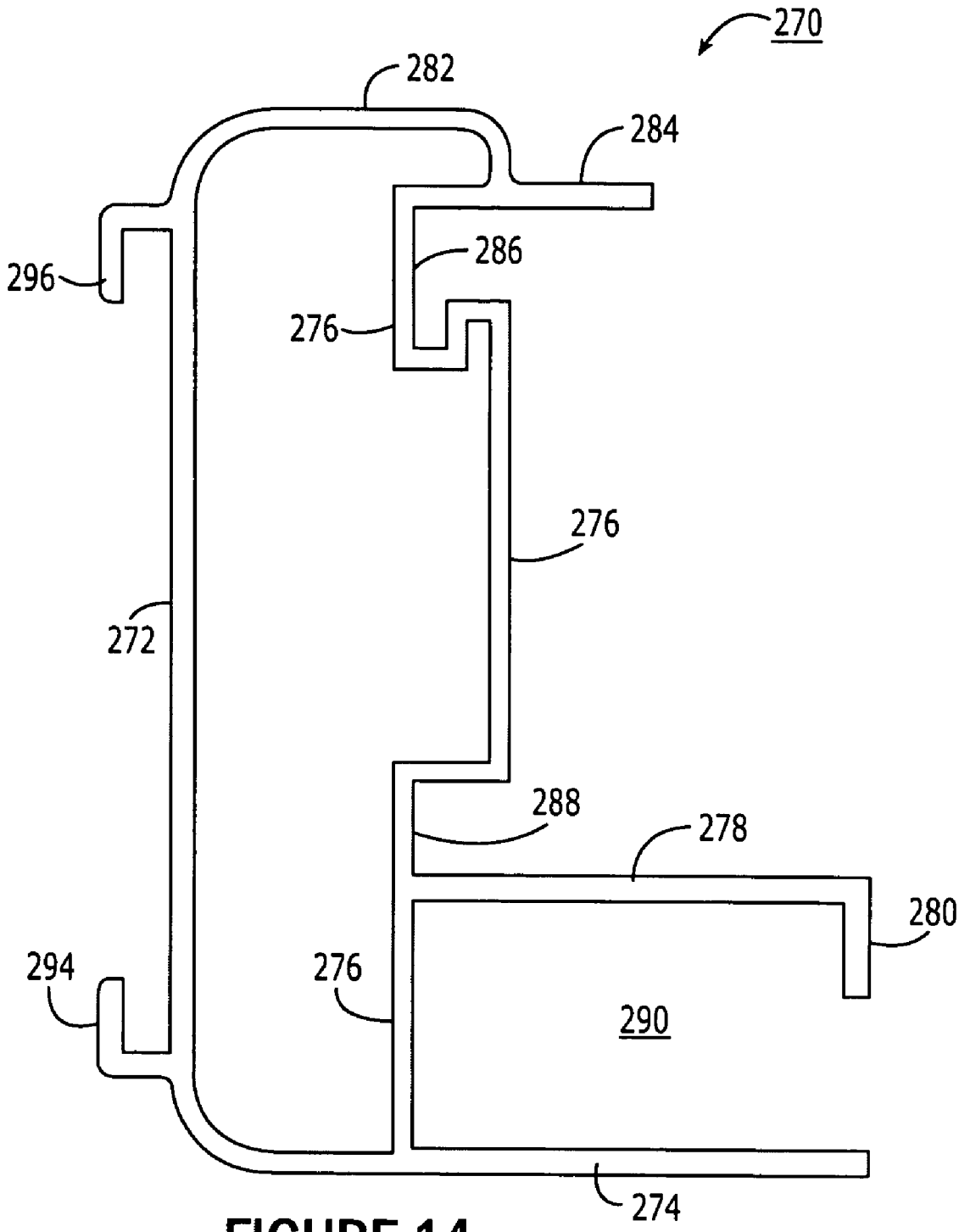
FIG. 14 is a top view of the extrusion which forms the corner posts of the display stand construction shown in FIGS. 10, 12 and 13.

Noting particularly FIGS. 13 and 14, each corner post 270 comprises a first outer wall 272 and a first inner wall 276 generally parallel with the first outer wall, and a second outer wall 274 generally orthogonal to the first outer wall 272, and a second inner wall 278 which is orthogonal to the first inner wall 276 and generally parallel to the second outer wall 274. A retaining tab 280 extends generally normal from the second inner wall toward the second outer wall, to form a cavity 290 which is adapted to receive an end portion 292 of a corresponding vertical support 224, with the retaining tab 280 extending into a corresponding vertical slot 266 or 268 (note FIGS. 12 and 13).

Each corner post 270 further includes an additional wall formed by portions 282, 284 extending generally normal to the first outer wall 272. The first inner wall 276 is molded so as to form two spaced vertical slots 286, 288 (FIG. 14). Referring now to FIGS. 12 and 13, a pair of vertical display panels 298, 300 are respectively supported in the slots 286, 288 between adjacent corner posts 270; and another pair of vertical display panels 302, 304 are also slidably retained in slots 286, 288 between opposing corner posts 270.

Noting FIGS. 12 and 14, each corner post 270 also includes a pair of tabs 294, 296 along the first outside surface 272 in order to hold another display element such as a mirror 306 or another form of graphic panel.

Figure 15:
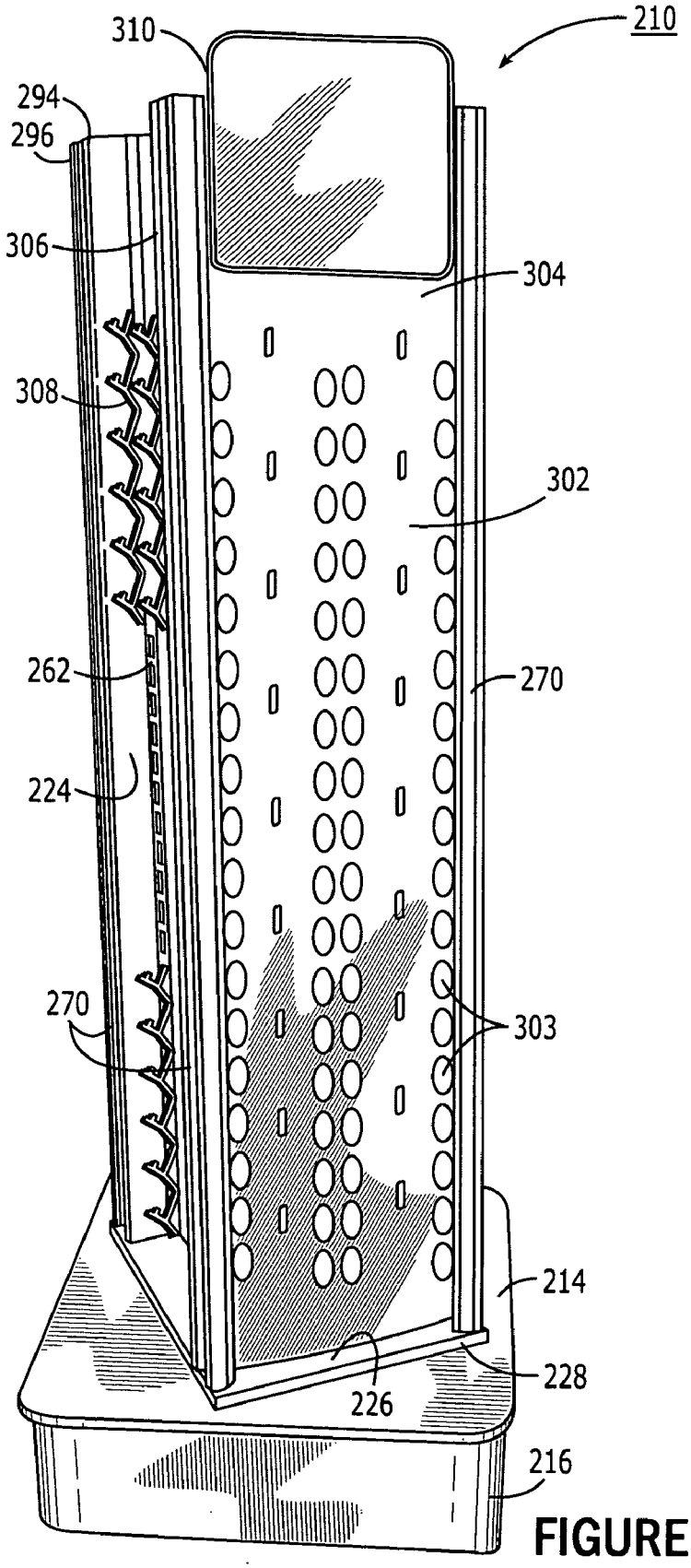
FIG. 15 is a front perspective view of the display stand shown in FIGS. 10–14.

An assembled version of the display stand 210 of FIGS. 10–14 is shown in FIG. 15. As there depicted, the display panel 302 comprises a transparent material which permits the use of a graphic design along the inner panel 304. The outer panel 302 may include holes 303 or other features which permit consumer products to be affixed to the outer display panel 302.

Figure 16:
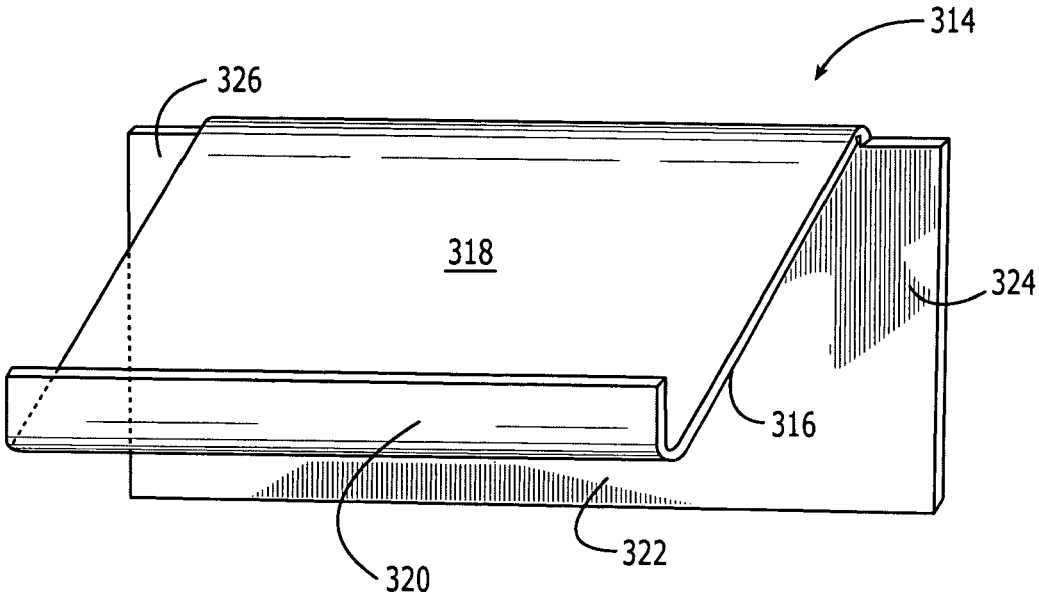
FIG. 16 is a perspective view of a shelving insert useful with the display stand embodiment of FIGS. 1–15.
Figure 17:
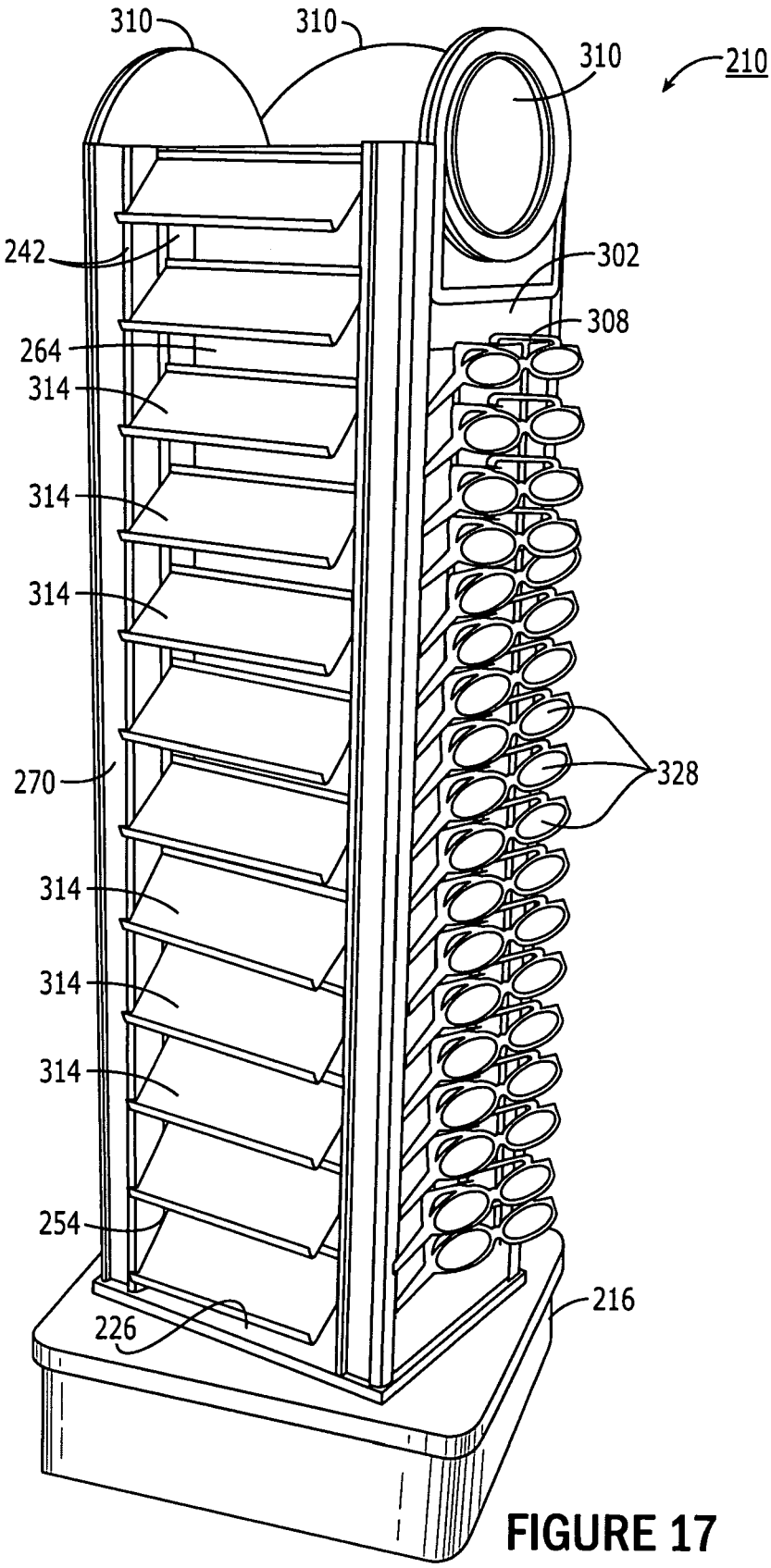
FIG. 17 is a perspective view of a display stand like that shown in FIG. 15, with multiple shelving inserts like that shown in FIG. 16.

Referring now to the left vertical side of the display 210 shown in FIG. 15, the recessed dimension of display panel 262 permits the use of extending consumer product supports such as that depicted as element 308, with the recessed area permitting the product and the display elements 308 to be protected from being inadvertently caught by passing consumers, carts and the like. This recessed feature is shown by arrows in FIG. 12. Alternatively, shelving like that shown in FIGS. 16 and 17 may be installed in the recessed area. The recessed shelving employs a shelving member referred to generally by reference numeral 314 in FIGS. 16 and 17. The shelving member 314 may, for example, be formed from transparent plastic sheeting 316 having an upper support surface 318 and a generally vertical retainer 320 at the outer extremity thereof. The shelving member 314 further includes a back plate 322 formed with the support surface 318, and a pair of slide tabs 324, 326 extending laterally from the back plate 322. The dimensions of the shelving member 314 are selected so that each shelving member unit may be slidably engaged in a pair of opposing slots, for example slots 254 in FIG. 12. In this way, one or more shelving members 314 may be used in place of the display panel 262 of FIG. 12, as shown in FIG. 17. In such an arrangement, the display stand may be utilized to present disparate consumer merchandise, for example sunglasses 328 along another panel 302, while different merchandise is being retained on the shelving members 314.

The use of facile display arrangements like that shown in FIGS. 1–17 permits seasonal graphics to be used as an inner display feature, thereby increasing the potential useful life of the display. By way of example, multiple graphic panels may be provided to the retailer by a visiting representative, or through storage with the display stands 12, 110 or 210, such as panels 312 (shown in dotted lines in FIG. 12). The changed graphic panels can, for example, include seasonal messages for Christmas holidays, winter scenes, spring scenes, summer scenes, Fourth of July graphics and the like. Different graphic displays may be printed on opposite sides of the inside panels (i.e., panels 50, 260, 264, 300 and 304 in FIGS. 3, 5, 12 and 13).

The slidable features of the corner posts 270 in FIGS. 10–17 also permit slidable display panels to be utilized as changeable message boards at the top, such as display element 310 in FIG. 15.

It will of course be understood by those skilled in the art that the corner posts and/or vertical supports shown in FIGS. 1–17 provide vertical uprights which support at least one pair of generally parallel display panels.

It will be recognized by those skilled in the art that various modifications and changes can be made in the display stand constructions, systems and methods shown and described above, without departing from the spirit and scope of this invention.

What is claimed is:

1. A stand for supporting and displaying multiple articles of one or more consumer products, comprising:

a base;

an elongated display stand supported generally vertically by the base, the display stand defined by plural elongated corner posts each of which is spaced from an adjacent corner post and extends along a substantial portion of the vertical dimension of the display stand with a display opening therebetween and each post including at least two generally parallel slots with each slot facing toward the adjacent corner post and extending generally vertically along the corresponding corner post, wherein opposing slots on adjacent corner posts are each positioned and dimensioned to receive a display panel therein, such that an adjacent pair of corner posts may simultaneously vertically support at least independent first and second generally parallel display panels between the adjacent corner posts;

a first vertically-extending, outermost display panel supported in opposing outermost slots of the adjacent corner posts and a second, innermost vertically-extending panel supported in opposing innermost slots of the adjacent corner posts; and means along the outermost display panel for supporting multiple articles of consumer products.

2. The display stand recited in claim 1, wherein each of the first and second vertically-extending panels comprises a thin flexible sheet.

3. The display stand recited in claim 1 wherein at least a portion of the outermost display panel is transparent such that the innermost display panel can be seen through the outermost display panel.

4. The display stand recited in claim 1, further comprising:

first and second elongated vertical supports carried by and extending vertically and generally parallel from the base, each support having an inner surface facing the inner surface of the other support, an opposing outer surface and vertically-extending ends; and wherein one of the corner posts is supported along each end of each vertical support.

5. The display stand recited in claim 4 further comprising means for supporting at least two additional vertically-extending display panels between the first and second supports generally orthogonal to the respective inner surfaces thereof.

6. The display stand recited in claim 4 further comprising:

a first pair of the first outermost and second innermost display panels supported in spaced relation to the outer surface of the first vertical support by a first opposing pair of the corner posts at the ends of the first vertical support; and another pair of first outermost and second innermost display panels supported by a second opposing pair of the corner posts at the ends of the second vertical support.

7. A stand for displaying multiple units of merchandise, the display stand comprising:

a base;

plural, generally elongated posts supported by the base in spaced relation with a display opening between adjacent pairs of the posts;

means for receiving and supporting an outer display panel and an inner display panel in display openings between an adjacent pair of the posts, the outer display panel being transparent and the inner display panel having graphics viewable through the outer display panel; and means along the outer display panel for receiving and supporting consumer merchandise thereon.

8. The display stand recited in claim 7 further comprising each post in one pair of the posts defining an inner, generally flat side facing and extending generally parallel with an inner, generally flat side of the other post with the corresponding display openings between the pair of posts.

9. The display stand recited in claim 8 wherein the display panels are supported vertically in the display opening.

10. The display stand recited in claim 8 further comprising means about at least a portion of the periphery of the display openings for removably supporting both the first and second display panels vertically.

11. The display stand recited in claim 10 wherein the removably supporting means comprises at least two generally parallel, vertically-extending slots extending along each inner flat face of each post, with an edge of one of the display panels supported in each slot.

12. A construction for a consumer product display stand, comprising:

a horizontal member;

at least two generally flat, elongated supports mounted on and extending vertically from an upper surface of the horizontal member, the vertical supports spaced apart from each other and each having an inner flat surface, an outer surface opposite the respective inner surface and opposing first and second edges;

at least four display panels slidably supported between the opposing inner surfaces of the vertical supports; and at least four slots extending vertically along each inner surface of each vertical support, with opposing pairs of slots slidably supporting one of the display panels.

13. A construction for a consumer product display stand, comprising:

a horizontal member;

at least two generally flat, elongated supports mounted on and extending vertically from an upper surface of the horizontal member, the vertical supports spaced apart from each other and each having an inner flat surface, an outer surface opposite the respective inner surface and opposing first and second edges;

at least two spaced display panels slidably supported between the opposing inner surfaces of the vertical supports;

a corner post slidably engaged along each first and second edge of at least one vertical support; and at least one display panel slidably supported between one pair of adjacent corner posts, and extending parallel and spaced from an outer surface of one of the vertical supports.

14. The construction for a consumer product display stand as recited in claim 13, further comprising another display panel slidably supported between the one pair of adjacent corner posts and extending parallel with and located between the outer surface of the adjacent vertical support and the one display panel supported between the pair of adjacent corner posts.

15. The construction for a consumer product display stand as recited in claim 14 further comprising:

a second pair of corner posts slidably engaged along the first and second edges of the second vertical support; and another pair of display panel slidably supported between the corner posts engaged with the second vertical support.

16. A construction for a consumer product display stand, comprising:

a horizontal member;

at least two generally flat, elongated supports mounted on and extending vertically from an upper surface of the horizontal member, the vertical supports spaced apart from each other and each having an inner flat surface, an outer surface opposite the respective inner surface and opposing first and second edges;

at least two spaced display panels slidably supported between the opposing inner surfaces of the vertical supports;

a pair of spaced retainer slots extending generally vertically along the outer surface of the at least one vertical support, each slot adjacent a corresponding one of the first and second edges; and wherein each corner post includes a retainer tab extending into a corresponding retainer slot.

17. The construction for a consumer product display stand as recited in claim 12 further comprising:

a base; and wherein the horizontal member is rotatably supported upon the base.

18. The display stand recited in claim 5 wherein the two additional vertically-extending display panels are recessed inwardly from adjacent ends of the first and second vertical supports.

19. The display stand recited in claim 18 wherein an outermost one of the additionally vertically-extending display panels comprises plural shelving members each slidably engaged in a corresponding pair of the opposing slots, each shelving member including an outwardly-extending support surface.

* * * * *